US005377569A

United States Patent [19]

Richards et al.

[11] Patent Number: 5,377,569

[45] Date of Patent: Jan. 3, 1995

[54] SIGNATURE BOOKLET MAKER WITH A MODIFIED FOLD BLADE AND A TRIM WASTE ELIMINATION DEVICE

[75] Inventors: Paul N. Richards, Fairport; Harry A. Hilbert, Ontario; Gary D. Juda, Rochester, all of N.Y.

[73] Assignee: Xerox Corporation, Stamford, Conn.

[21] Appl. No.: 57,802

[22] Filed: May 7, 1993

[51] Int. Cl.[6] ..... B26D 7/18

[52] U.S. Cl. ..... 83/98; 83/397; 83/544; 83/701; 83/934

[58] Field of Search ..... 83/98, 99, 397, 934, 83/701, 544, 545, 546

[56] References Cited

U.S. PATENT DOCUMENTS

| | | | |
|---|---|---|---|
| 1,072,316 | 9/1913 | Cundall | 83/98 |
| 1,823,501 | 9/1931 | Messinger, Jr. | 83/98 |
| 2,763,324 | 9/1956 | Loverch et al. | 83/397 X |
| 4,445,409 | 5/1984 | Mohr et al. | 83/157 |
| 4,595,187 | 6/1986 | Bober | 270/37 |
| 4,727,402 | 2/1988 | Smith | 355/319 |
| 4,905,977 | 3/1990 | Vijuk | 270/45 |
| 4,976,089 | 12/1990 | Reichelt | 83/98 X |
| 5,076,556 | 12/1991 | Mandel | 270/45 |
| 5,090.683 | 2/1992 | Kamath et al. | 271/227 |

*Primary Examiner*—Richard K. Seidel

*Assistant Examiner*—Kenneth E. Peterson

*Attorney, Agent, or Firm*—Oliff & Berridge

[57] ABSTRACT

A signature booklet maker (SBM) finishing apparatus for an image producing device includes a modified fold blade having a plurality of contacting teeth spaced part by a predetermined distance. The contacting teeth further include a predetermined contact surface width and a predetermined thickness. The grind direction of the teeth is specified to reduce inside sheet drag during folding. The spaced teeth are adapted drive the stitched signature set in a folding unit without contacting the stitches, thereby eliminating fold skew and inside sheet marking. Moreover, the fold blade has a predetermined hardness to ensure that the blade is not damaged during folding. The SBM further includes a trim waste elimination device and knife guard to prevent booklet trimmings from migrating throughout the trimmer unit. The knife guard eliminates the safety hazard caused by the blade in the resting position and guides air from an air blower to force booklet trimmings into a waste chute. A discontinuity bracket on the blade reduces the surface area for trimmings to become adhered to the blade by static electricity. The apparatus provides for a substantial increase in the quality of the output and in the aesthetic appearance of the booklet.

15 Claims, 4 Drawing Sheets

SIGNATURE BOOKLET MAKER WITH A MODIFIED FOLD BLADE AND A TRIM WASTE ELIMINATION DEVICE

BACKGROUND OF THE INVENTION

The present invention is directed to a finishing apparatus for an image producing device, and more particularly, to a signature booklet maker (SBM) having a modified fold blade and a trim waste elimination device.

A "signature" is a duplex printed copy sheet having two page images on each side. The signature sheet can be folded in half to form a booklet or a plurality of signatures can be aligned, stitched together, and folded in half to form a multi-sheet booklet. A description of signature printing is provided in U.S. Pat. No. 4,727,402 to Smith, the disclosure of which is incorporated herein by reference.

The SBM can be constructed, for example, from variants of three existing finishing modules such as the AGR/Automatic Stitcher, the PA/Automatic Folder, and the TR/Automatic Trimmer, manufactured by C. P. Bourg for off-line use. All modules require mechanical modification to support front edge registration vs. center registration and wiring modification to share basic signals with the printer. The printer exports sheet arrival times and end-of-set signals to the SBM equipment. The first module receives and aligns the copy sheets in a set (which set forms a single booklet) so that all sheets in the set are aligned with one another. The first module aligns each sheet by stopping the forward movement of the sheet (e.g., with a gate or sheet stop), and then laterally tapping each sheet against another sheet stop. Once all sheets in the set are received and aligned, the first module stitches or binds all the sheets in the set to each other at a central location (between each page image on each sheet). The stitching step can comprise, for example, stapling. Thus, the first module is referred to as a "saddle stitcher."

The stitched copy set is then forwarded to a second module which folds the stitched copy set in half about the stitch axis. Thus, the second module is referred to as a "folder."

The folded copy set is then forwarded to a third module where the edges of the sheets opposite from the fold are trimmed. Thus, the third module is referred to as a "trimmer." Trimming is necessary, particularly in large sets or booklets, because the edges of the sheets opposite from the fold become uneven after folding.

A problem arises in the folding module in that the direct contact of the fold blade and the stitches often cause the occurrence of fold skew (i.e., the stitches fall on either side of the fold blade) and inside sheet marking. These problems have a significant effect on the final appearance of the booklet. Moreover, as a result of fold skew, when the booklet is transferred to the trimming module, the pages are then trimmed in an uneven manner.

Another problem arises in that static electricity on the sheet output can cause major problems in the machine performance throughout the signature booklet maker. Namely, the booklet trimmings adhere to the sheet affecting the final output and causing paper jams. Still further, it is difficult to keep booklet trimmings from migrating throughout the trimming module. The migration of trimmings causes false shutdowns at jam switches and trim waste on the exit conveyer and inside booklets.

Yet another problem with the existing signature booklet maker arrangement arises in that the upper knife assembly of the trimming module is exposed and can be a significant safety hazard for the operator.

SUMMARY OF THE INVENTION

It is an object of the present invention therefore to provide a signature booklet maker having a modified fold blade and a trim waste elimination device and knife guard which overcomes the problems of the prior art.

To achieve the foregoing and other objects, a trimming unit is provided and includes a trimming device for trimming edges of a plurality of folded pages, a trimming disposal device for disposing the trimmed edges, and an air blower for directing air flow to force the trimmed edges into the trimming disposal device.

In another aspect of the present invention a trimming unit is provided including an upper knife member movable in a plane between a resting position and a trimming position. A lower knife member is disposed adjacent the plane such that the upper knife member and the lower knife member are adjacent each other when the upper knife member is in the trimming position enabling a concerted cutting action between the upper and lower knife members. The apparatus further includes a waste chute for receiving trimmings cut by the upper and lower knife members. An air blower is disposed on one side of the upper knife member and blows air towards the upper knife member in the trimming position. A knife guard is disposed between the upper knife member and the air blower.

In another aspect of the present invention, the knife guard is pivotally attached to the trimming unit and is pivoted between a closed and an open position when the upper knife member is moved between the resting and trimming position, respectively. The knife guard is urged toward the closed position by a spring wherein the upper knife member, in the trimming position, shifts the knife guard to the open position against the force of the spring. The knife guard further includes an aperture at a central location therein. The aperture allows air from the air blower to flow through the knife guard. In yet another embodiment, the knife guard further includes an air guide member fixed to the knife guard adjacent the aperture for guiding the air from the air blower through the aperture in the knife guard.

In yet another aspect of the present invention, the trimming unit further includes an arrangement for reducing the surface area for trimmings to become adhered to the upper knife member by static electricity. The arrangement can include either a discontinuity bracket or any other arrangement which will prevent static electricity from building on the knife member.

In still another aspect of the present invention a fold blade is provided for a folding unit which is adapted to drive a plurality of stitched pages through a pair of rollers. The fold blade includes a base member having a predetermined thickness and a predetermined hardness and a plurality of teeth members integral with the base member. The teeth members are spaced apart such that they drive the plurality of stitched pages through the pair of rollers without contacting the stitches, wherein the teeth members have a predetermined contact surface width.

In yet another aspect of the present invention, a finishing apparatus is provided for an image producing device. The finishing apparatus includes a saddle stitcher disposed downstream of a sheet feeder. The saddle stitcher includes an arrangement for stacking and aligning a plurality of sheets and a device for stitching the stacked sheets to form a stitched booklet. The finishing apparatus further includes a folding unit having a fold blade as discussed above and a trimming unit as discussed above.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

Figure 1:
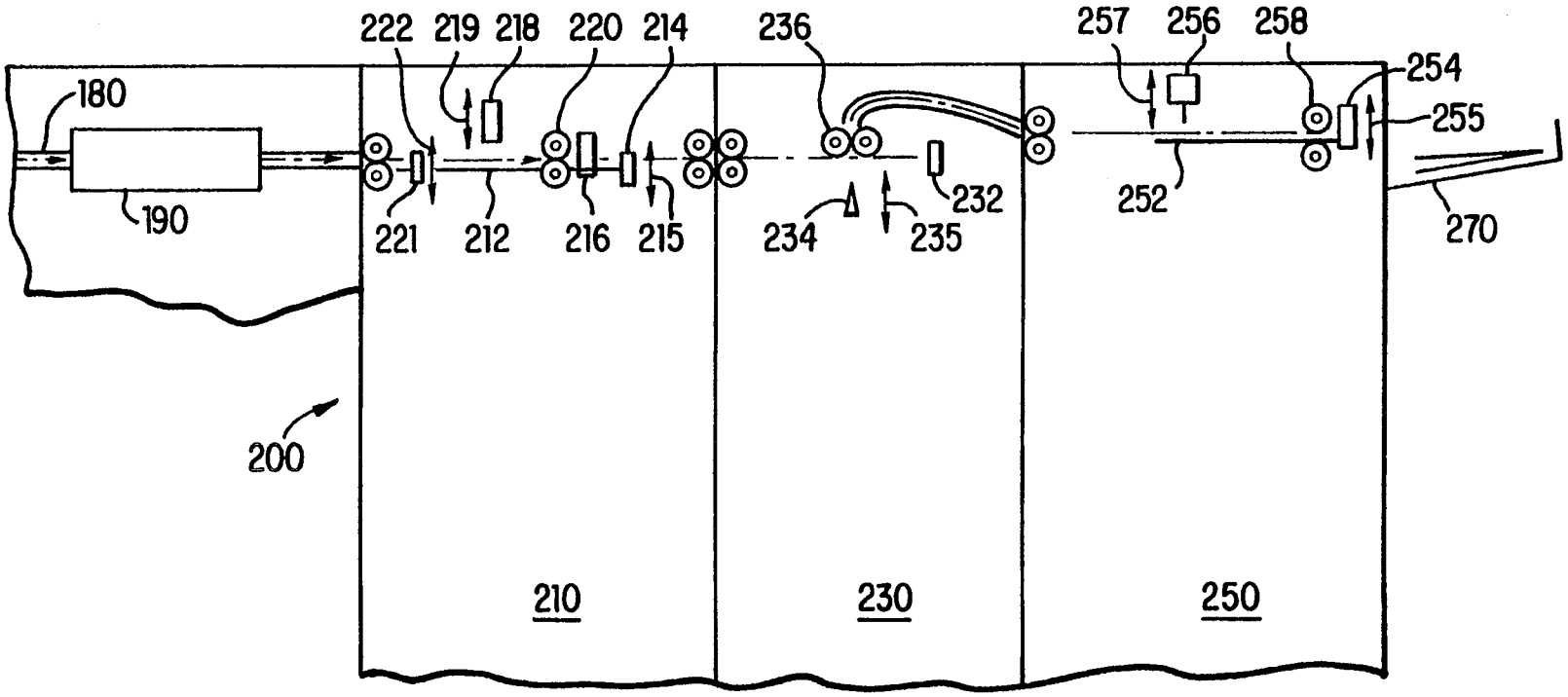
FIG. 1 is schematic view of a signature booklet maker.

FIG. 1 is a schematic view of a Signature Booklet Maker (SBM) for on-line use with a printing system. The SBM 200 includes a saddle stitcher module 210, a folder module 230, and a trimmer module 250.

When large copy sheets (11×17 or A3) are signature printed, they are conveyed through and exit the duplex paper path short edge first, are fed through bypass 180 and into SBM 200 short edge first. When small copy sheets (8½×11 inch or A4) are signature printed, they are conveyed through and exit the duplex paper path long edge first and are fed through bypass 180. If these smaller sheets are to be folded across their long edge by the SBM, they must be rotated 90° prior to insertion into the SBM. Accordingly, a sheet rotary 190 is provided in the sheet bypass 180 for rotating sheets 90°. The smaller sheets, of course, can also be folded across their short edge by the SBM. In this instance, the copy sheets fed long edge first are not rotated by sheet rotary 190.

Although a variety of well known rotators can be used, it is preferable to use a sheet rotator employing a single stepper motor which contacts one side of a sheet to selectively decrease the velocity of that side (while a constant velocity roller-operating at the sheet bypass speed-engages and maintains the opposite side of the sheet at a constant velocity) to cause the sheet to rotate. Particularly, the sheet rotator disclosed in U.S. Pat. No. 5,090,683 to Venkatesh H. Kamath et al., filed Jul. 31, 1990 and entitled "Electronic Sheet Rotator With Deskew, Using Single Variable S Roller", the disclosure of which is incorporated herein by reference, can be used. The stepper motor is maintained at the constant sheet bypass velocity if it is not necessary to rotate the sheets. For example, it is also possible to feed 8½×11 inch sheets into the SBM long edge first (without rotating) to form pamphlets having a final dimension (after folding) of 4½×11 inches.

Signature-printed copy sheets are deflected through sheet bypass 180 (rotated by sheet rotator 190 if necessary) and received by saddle stitcher 210. The copy sheets are received on a receiving tray 212 after entering stitcher 210 from sheet bypass 180. The forward movement of the sheets is stopped by a movable gate 214. Gate 214 moves in the direction indicated by line 215 to stop the sheets, or permit the sheets to move downstream of saddle stitcher 210. When a booklet is to be formed from a plurality of signature-printed copy sheets, gate 214 remains in the position where it blocks the passage of copy sheets through saddle stitcher 210. Each sheet is stopped by gate 214, and then tapped by an aligner 216 to side register each sheet.

After every copy sheet in a set of copy sheets is stopped by gate 214 and side aligned by aligner 216, a movable edge tamper 221 is positioned at the trail edge of the aligned copy sheets. Trail edge tamper 221 moves in the direction indicated by line 222 to secure the copy sheets in position for stitching. Stitchers 218, which move in the direction indicated by line 219, move downward to stitch all the signature printed copy sheets in the set to form a stitched booklet. Stitching can include, for example, stapling. After being stitched, the bound set of signature-printed copy sheets is forwarded to folder 230. In order to forward sheets out of saddle stitcher 210, gate 214 is moved so as to unblock the sheet passage out of saddle stitcher 210. Additionally, a sheet conveyor is contacted with the bound set to convey the set out of stitcher 210. The sheet conveyor can comprise, for example, a set of rollers 220 which are selectively movable toward and away from each other to engage and drive or disengage and not drive the set of copy sheets. For one example of a saddle stitcher, see U.S. Pat. No. 4,595,187 to Bober, the disclosure of which is incorporated herein by reference.

Folder 230 receives a set of bound signature-printed copy sheets, the forward motion of which is stopped by sheet stop 232. The set of bound signature-printed copy sheets is then folded by a sheet folder. One type of sheet folder can include a vertically movable fold blade 234 which contacts the signature sheets at a central location thereof (where the signature-printed copy sheets are stitched) and forces the central portion of the set of sheets between folding rollers 236. Fold blade 234 moves in the direction indicated by line 235. Folding rollers 236 fold the set of signature-printed copy sheets and convey the set out of folder 230 to trimmer 250. For further details of folders using a fold blade and a pair of rollers see, for example, U.S. Pat. No. 4,905,977 to Vijuk, the disclosure of which is incorporated herein by reference. Of course, other types of folders such as those disclosed in U.S. Pat. No. 5,076,556 filed July 1991 to Barry Mandel, the disclosure of which is incorporated herein by reference, can alternatively be used to place folds in sets of documents.

After being folded, the set of signature-printed copy sheets are received on tray 252 of trimmer 250. The forward movement of the folded signature-printed set is stopped by movable sheet stop 254 (which moves in the vertical direction indicated by line 255). After being stopped, the uneven edges of the folded signature set are trimmed by the cutting blade of trimmer 256 which moves in the vertical direction as indicated by line 257. After being trimmed, the folded signature set (or booklet) is fed by rollers 258 out of trimmer 250 and onto a tray 270 or other type of stacking unit.

It is understood that the location of the various sheet stops can be adjustable so that the SBM can form signature booklets from copy sheets having a variety of sizes. It is also understood that other types of stitchers, folders and trimmers can be used with the present invention to form signature booklets.

Additionally, the SBM modules can be modified to edge stitch standard (non-signature) jobs. Edge stitching is defined as placing one or more stitches along the short or long edge of a set (versus the saddle stitch position). To provide edge stitching with SBM equipment, the stitchers 218 are repositioned within the stitcher module and the folding and trimming modules are bypassed.

Figure 2:
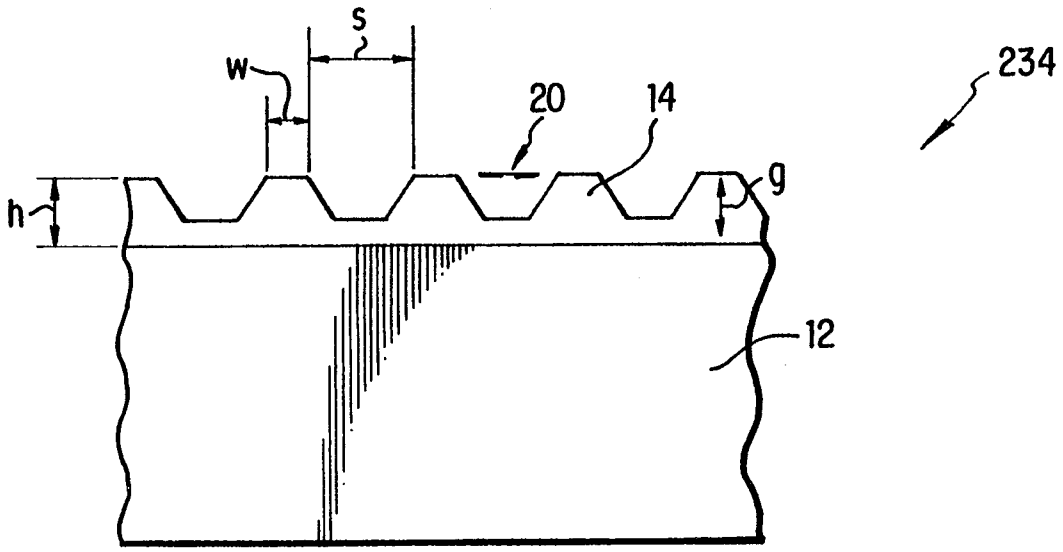
FIG. 2 is a side view of a fold blade of the present invention.
Figure 2A:
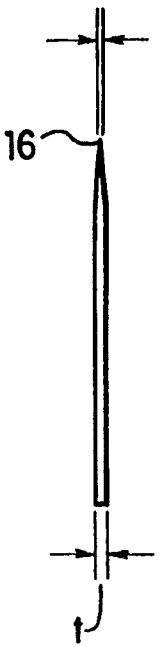
FIG. 2A is a longitudinal view showing the cross-section of the fold blade of the present invention.

Referring to FIGS. 2 and 2A, there is depicted a modified fold blade for the SBM of the present invention. Fold blade 234 includes a base, member 12 integral with a plurality of teeth 14. Teeth 14 are spaced apart a predetermined pitch s in the range of 12–20 mm and preferably about 15 mm. This pitch is chosen to substantially correspond to the pitch of stitches 20 allowing proper clearance for the stitch width during folding. Pitch s is determined such that teeth 14 contact the stitched pages preferably without contacting stitches 20. The prior art fold blade contacts the stitches during folding causing the blade to skew to either side of the pages. As a result, the pages are folded unevenly thereby affecting the trimming operation and reducing the aesthetic appearance. Teeth 14 further have a predetermined contact surface width w of preferably about 2 mm to ensure proper blade-to-sheet contact across all booklet sizes. The tooth height h is preferably about 11 mm. The thickness t of blade 234 is preferably about 1 mm.

Fold blade 234 is formed having a predetermined blade hardness of Rc 47–50. This ensures that the blade is not damaged by stitch contact. Although fold blade 234 is adapted to avoid contact with stitches 20, depending on the size of the booklet and the pitch of teeth 14, a tooth corner may contact a stitch during folding and the pitch of teeth 14. Accordingly, the hardness of teeth 14 must be greater than that of stitches 20 to prevent potential damage to teeth 14 of fold blade 234. Moreover, teeth 14 are formed using a vertical grind direction. A rotating grind wheel (not shown) or the like, tapers teeth 14 by a rotary grinding process. The direction of the rotation of the grind wheel is substantially parallel to the vertical motion of the fold blade indicated by line 235. A vertical grind direction causes the "grain" of teeth 14 to be parallel to the blade motion 235. Thus, the proper grind direction reduces inside sheet drag during folding eliminating inside sheet marking caused by the folding module. The tip 16 of the fold blade 234 tapers to a thickness in the range of 0.1 to 0.3 mm, and preferably about 0.2 mm. The above described fold blade 234 provides superior results from the folding module eliminating fold skew and inside sheet marking thereby maximizing quality and aesthetic appearance.

Figure 3:
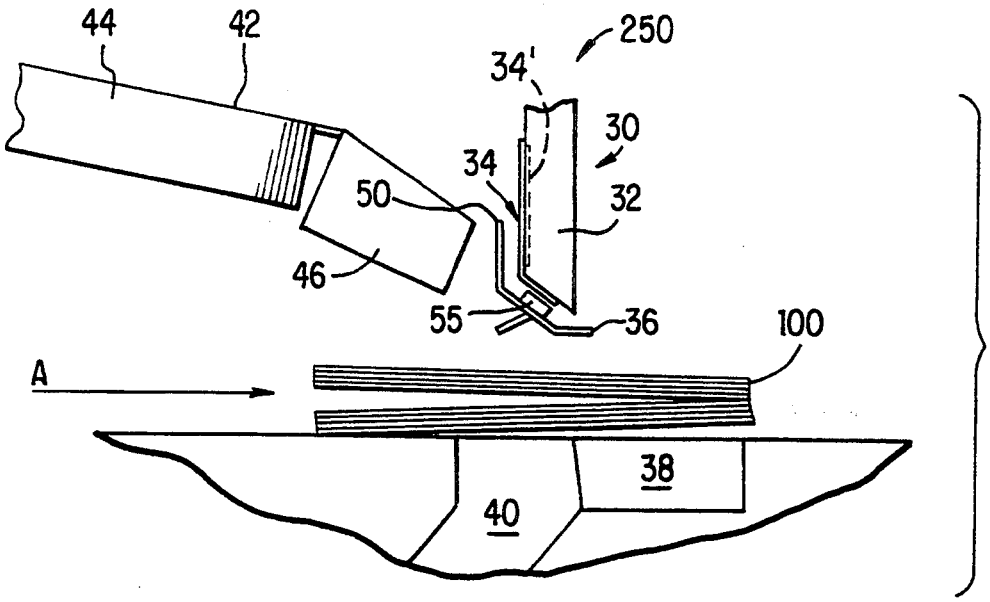
FIG. 3 is schematic illustration of the trim waste elimination device of the present invention in the resting position.
Figure 4:
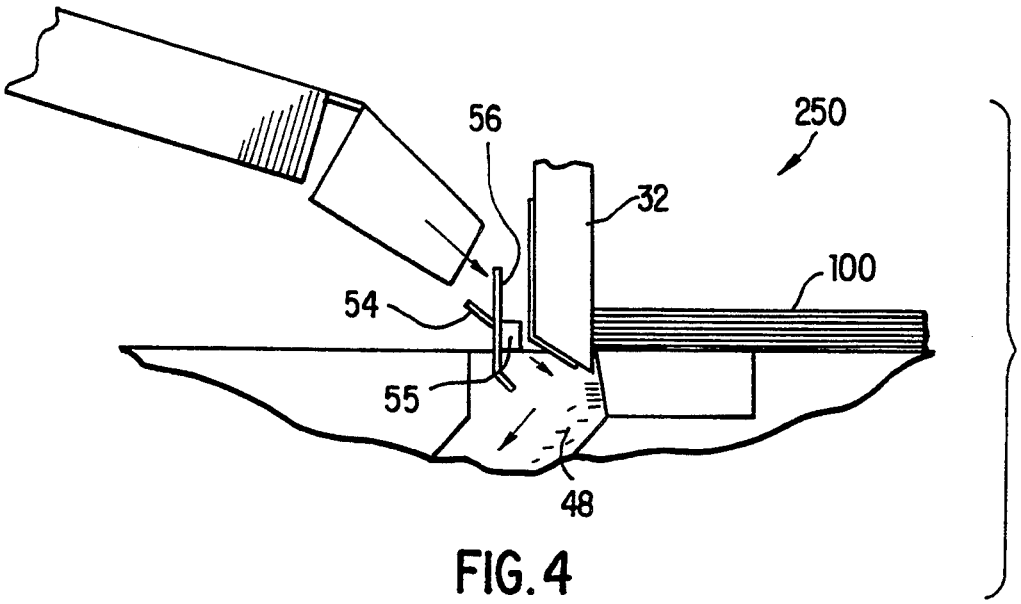
FIG. 4 is a schematic illustration of the trim waste elimination device of the present invention in the trimming position.

Referring to FIGS. 3–4, trimming unit 250 includes an upper knife unit 30 having an upper knife member 32, a discontinuity bracket 34 and a knife guard 36. Trimming unit 250 also includes a lower knife member 38 and a blower assembly 42 which comprises a centrifugal blower 44 and an air diversion bracket 46. A waste chute 40 is disposed at a bottom portion of trimming unit 250 adjacent lower knife member 38.

The operation of trimming unit 250 will be described in detail in conjunction with FIGS. 3 and 4. A signature booklet of stitched and folded pages 100 is conveyed from the folding unit 230 in a conventional manner in the direction indicated by arrow A in FIG. 3. As described above, the, forward movement of the folded signature printed set 100 is stopped by movable sheet stop 254 (FIG. 1) which moves in the vertical direction indicated by line 255. Upper knife member 32 is movable in a vertical plane between a resting position (FIG. 3) and a trimming position (FIG. 4). Lower knife member 38 is disposed directly adjacent the plane such that the upper knife member 32 and the lower knife member 38 are adjacent each other when the upper knife member 32 is in the trimming position enabling a concerted cutting action between the upper and lower knife members. Referring to FIG. 4, this cutting action trims the uneven edges of the folded signature set 100 resulting from the folding operation.

The booklet trimmings 48 are guided into waste chute 40 by centrifugal blower 44 and air diversion bracket 46. Air diversion bracket 46 directs the air from blower 44 into the trimming area of upper knife member 32 and the lower knife member 38 in the trimming position.

Upper knife unit 30 also includes a discontinuity bracket 34 fixed to the upper knife member 32. The bracket creates discontinuity to the ground surface of the upper knife member 32 which reduces the surface area for trimmings to become adhered by static electricity to the knife. Discontinuity bracket 34 can be formed of any material that creates a discontinuity in the surface of upper knife member 32. In a preferred embodiment, discontinuity bracket 34 is formed of stainless steel, however, cold rolled electroless nickel plated steel also provides satisfactory results. Discontinuity bracket 34 is fixed to the upper knife member 32 by any feasible fixing means depending on the material and in a preferred embodiment, by screws. Alternatively, ridges can be ground into the blade itself to achieve the same object.

Figure 5:
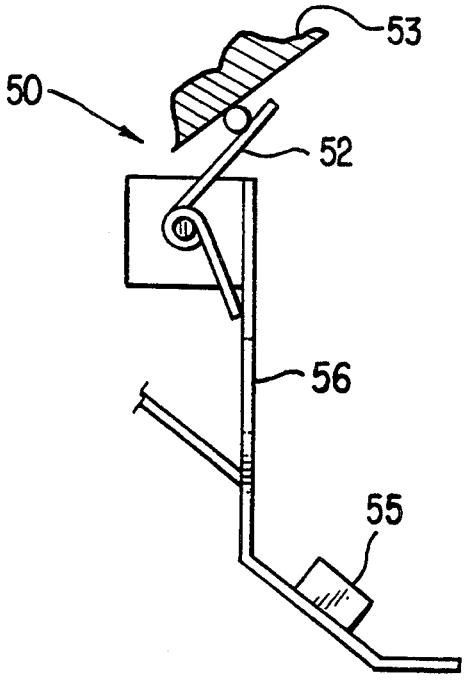
FIG. 5 shows a blown-up view of the knife guard of the trim waste elimination device.

Knife guard 36 is pivotable about a pivot point 50 between a safety position (FIG. 3) and an operating position (FIG. 4). Referring to FIG. 5, knife guard 36 is biased toward the safety position by means of a torsion spring 52. Spring 52 is fixed at one end to knife guard 36 and at another end to a supporting member 53. In the safety position, knife guard 36 covers the blade edge eliminating a potential safety hazard. Knife guard 36 also includes a pad 55 disposed between upper blade member 32 and knife guard 36. As upper blade member 32 shifts between the resting position and the trimming position, the knife guard is pivoted to the operating position (FIG. 4) against the force of spring 52. Upper blade member 32 contacts pad 55 to push knife guard 36 towards the operating position. Pad 55 prevents the cutting edge of upper blade member 32 from coming in contact with knife guard 36, thereby avoiding unnecessary wear on the blade and extending the life of the blade. Pad 55 is preferably made of a plastic material such as acetal.

In the trimming position, knife guard 36 assists in air flow to the blade discontinuity surface for effective trim removal. Knife guard 36 includes an air guide member 54 for guiding the air from blower 44 to force the trimmings 48 into the waste chute 40. Knife guard 36 further includes an aperture 56 allowing the air from blower 44 to flow through knife guard 36. After the trimming operation, knife guard 36 returns to the safety position via the force of spring 52 as upper knife member 32 returns to the resting position.

While the embodiments disclosed herein are preferred, it will be appreciated from this teaching that various alternatives, modifications, variations or improvements therein may be made by those skilled in the art that are within the scope of the invention, which is defined by the following claims.

What is claimed is:

1. A trimming unit for trimming edges of folded pages, the trimming unit comprising:

an upper knife member movable in a plane between a resting position and a trimming position;

a lower knife member disposed adjacent said plane such that said upper knife member and said lower knife member are adjacent each other when said upper knife member is in said trimming position enabling a concerted cutting action between said upper and lower knife members to cut said edges of said folded pages;

a waste chute for receiving trimmings cut by said upper and lower knife members;

an air blower disposed on one side of said upper knife member, said air blower blowing air towards said upper knife member directing all of said trimmings toward said waste chute; and a knife guard disposed between said upper knife member and said air blower.

2. A trimming unit according to claim 1, wherein said knife guard is pivotally attached to the trimming unit, said knife guard being pivoted between a closed and an open position when said upper knife member is moved between said resting and trimming position, respectively, wherein said knife guard is urged towards said closed position by a spring, said upper knife member, in said trimming position, shifting said knife guard to said open position against the force of said spring.

3. A trimming unit according to claim 2, wherein said knife guard comprises an apertured central portion, said apertured portion allowing air from said air blower to flow through said knife guard.

4. A trimming unit according to claim 3, wherein said knife guard further comprises an air guide member fixed to said knife guard adjacent said apertured portion, said air guide member guiding air from said air blower through said apertured portion in said knife guard.

5. A trimming unit according to claim 1, further comprising a plurality of ridges formed on said one side of said upper knife member.

6. A trimming unit according to claim 1, further comprising a discontinuity bracket fixed to said one side of said upper knife member.

7. A trimming unit comprising:

trimming means for trimming edges of a plurality of folded pages, said trimming means comprising an upper knife member;

trimming disposal means for disposing the trimmed edges;

air blower means for directing air flow to force all of the trimmed edges toward the trimming disposal means; and a plurality of ridges formed on one side of said upper knife member.

8. A knife guard for a reciprocating cutting blade of a trimming unit having an air blower, wherein said knife guard is disposed between said cutting blade and said air blower, said knife guard comprising a central apertured portion, said apertured portion allowing air from said air blower to flow through said knife guard along said cutting blade.

9. A knife guard according to claim 8, wherein said knife guard further comprises an air guide member fixed to said knife guard adjacent said apertured portion, said air guide member guiding air from said air blower through said apertured portion in said knife guard.

10. A knife guard according to claim 9, wherein said knife guard is pivotable between a closed position and an open position when said cutting blade is moved between a resting position and a trimming position, respectively, wherein said knife guard is urged towards said closed position by a spring, said cutting blade, in said trimming position, shifting said knife guard to said open position against the force of said spring.

11. A trimming unit, comprising:

trimming means for trimming edges of a plurality of folded pages, said trimming means comprising an upper knife member;

trimming disposal means for disposing the trimmed edges;

air blower means for directing air flow to force all of the trimmed edges toward said trimming disposal means; and a discontinuity bracket fixed to one side of said upper knife member.

12. A trimming unit according to claim 11, wherein said upper knife member is movable in a plane between a resting position and a trimming position, said trimming means further comprising a lower knife member disposed adjacent said plane such that said upper knife member and said lower knife member are adjacent each other when said upper knife member is in said trimming position enabling a concerted cutting action between said upper and lower knife members.

13. A trimming unit according to claim 12, wherein said trimming disposal means comprises a waste chute for receiving trimmings cut by said upper and lower knife members.

14. A trimming unit according to claim 11, wherein said air blower means comprises an air blower disposed on one side of said upper knife member, said air blower blowing air towards said upper knife member, and a knife guard disposed between said upper knife member and said air blower.

15. A finishing apparatus for an image producing device, said finishing apparatus comprising:

a saddle stitcher disposed downstream of a sheet feeder, said saddle stitcher comprising means for stacking and aligning a plurality of sheets and means for stitching the stacked sheets to form a stitched booklet;

a folding unit disposed downstream of said saddle stitcher, said saddle stitcher further comprising means for conveying said stitched booklet to said folding unit, wherein said folding unit comprises a fold blade adapted to drive said stitched booklet through a pair of rollers thereby folding said stitched booklet, said fold blade comprising:

a base member having a predetermined thickness and a predetermined hardness; and a plurality of teeth members integral with said base member, said teeth members being spaced apart such that they drive said stitched booklet through said pair of rollers without contacting the stitches, wherein said teeth members have a predetermined contact surface width; and a trimming unit adapted to trim edges of the folded stitched booklet, said trimming unit comprising:

an upper knife member movable in a plane between a resting position and a trimming position;

a lower knife member disposed adjacent said plane such that said upper knife member and said lower knife member are adjacent each other when said upper knife member is in said trimming position enabling a concerted cutting action between said upper and lower knife members to cut said edges of said folded stitched booklet;

a waste chute for receiving trimmings cut by said upper and lower knife members;

an air blower disposed on one side of said upper knife member, said air blower blowing air towards said upper knife member directing all of said trimmings toward said waste chute; and a knife guard disposed between said upper knife member and said air blower.

* * * * *